US010221471B2

(12) United States Patent
Handa et al.

(10) Patent No.: US 10,221,471 B2
(45) Date of Patent: Mar. 5, 2019

(54) HIGH STRENGTH ALUMINUM ALLOY SHEET EXCELLENT IN BENDABILITY AND SHAPE FREEZABILITY AND METHOD OF PRODUCTION OF SAME

(71) Applicant: Nippon Light Metal Company, Ltd., Tokyo (JP)

(72) Inventors: Takeshi Handa, Shizuoka (JP); Kiyomi Tsuchiya, Shizuoka (JP); Toshiya Anami, Shizuoka (JP)

(73) Assignee: Nippon Light Metal Company, Ltd., Tokyo (JP)

( * ) Notice: Subject to any disclaimer, the term of this patent is extended or adjusted under 35 U.S.C. 154(b) by 385 days.

(21) Appl. No.: 15/030,497

(22) PCT Filed: Dec. 24, 2014

(86) PCT No.: PCT/JP2014/084131
§ 371 (c)(1),
(2) Date: Apr. 19, 2016

(87) PCT Pub. No.: WO2015/155911
PCT Pub. Date: Oct. 15, 2015

(65) Prior Publication Data

US 2016/0265095 A1 Sep. 15, 2016

(30) Foreign Application Priority Data

Apr. 9, 2014 (JP) ..... 2014-080201

(51) Int. Cl.
*C22F 1/00* (2006.01)
*C22F 1/04* (2006.01)
*C22C 21/00* (2006.01)

(52) U.S. Cl.
CPC ..... *C22F 1/04* (2013.01); *C22C 21/00* (2013.01); *C22F 1/00* (2013.01)

(58) Field of Classification Search
CPC ..... C22C 21/00; C22F 1/04
See application file for complete search history.

(56) References Cited

U.S. PATENT DOCUMENTS 4,235,628 A * 11/1980 Althoff ..... A47J 36/02 420/534
2005/0205177 A1* 9/2005 Hong ..... C22C 21/08 148/692
2009/0007994 A1* 1/2009 Zhao ..... B22D 11/003 148/523
2009/0081072 A1* 3/2009 Zhao ..... C22C 21/02 420/535
2009/0084474 A1* 4/2009 Cheong ..... C22C 21/00 148/693
2010/0139899 A1* 6/2010 Suzuki ..... F28F 21/084 165/151
2015/0075677 A1* 3/2015 Hirayama ..... C22C 21/06 148/551
2015/0252461 A1* 9/2015 Kokubo ..... C22C 21/02 148/551
2015/0368771 A1* 12/2015 Hentschel ..... C22C 21/00 420/532

FOREIGN PATENT DOCUMENTS

| | | | |
|---|---|---|---|
| JP | 07-242973 A | | 9/1995 |
| JP | 2000-104149 A | | 4/2000 |
| JP | 2003-105469 A | | 4/2003 |
| JP | 2004-2985 A | | 1/2004 |
| JP | 2009-19267 A | | 1/2009 |
| JP | 4339869 B2 | | 7/2009 |
| JP | 2010-121164 A | | 6/2010 |
| JP | 2010-126804 A | | 6/2010 |
| JP | 2010126804 A | * | 6/2010 |
| JP | 2012-224929 A | | 11/2012 |

OTHER PUBLICATIONS

International Search Report dated Feb. 17, 2015 issued in corresponding PCT/JP2014/084131 application (pp. 1-2).
English Abstract of JP 07-242973 A published Sep. 19, 1995.
English Abstract of JP 2000-104149 A published Apr. 11, 2000.
English Abstract of JP 2003-105469 A published Apr. 9, 2003.
English Abstract of JP 2004-002985 A published Jan. 8, 2004.
English Abstract of JP 2006-219762 A published Aug. 24, 2006 which corresponds to JP 4339869 B2.
English Abstract of JP 2009-019267 A published Jan. 29, 2009.
English Abstract of JP 2010-121164 published Jun. 3, 2010.
English Abstract of JP 2010-126804 A published Jun. 10, 2010.
English Abstract of JP 2012-224929 A published Nov. 15, 2012.

* cited by examiner

*Primary Examiner* — Keith Walker
*Assistant Examiner* — Catherine P Smith
(74) *Attorney, Agent, or Firm* — Millen White Zelano and Branigan, PC; Csaba Henter

(57) ABSTRACT

3000-series aluminum alloy sheet which has a high strength enabling application to automobile body panel and excellent in bendability and shape freezability is provided.

6 Claims, No Drawings

HIGH STRENGTH ALUMINUM ALLOY SHEET EXCELLENT IN BENDABILITY AND SHAPE FREEZABILITY AND METHOD OF PRODUCTION OF SAME

TECHNICAL FIELD

The present invention relates to a 3000-series aluminum alloy sheet excellent in bendability and shape freezability which can be used for automobile body panels etc.

BACKGROUND ART

To apply an aluminum alloy sheet as automobile body panels, it is necessary to use a press die to form it into a desired shape. The 5000-series aluminum alloy sheet controlled in texture and excellent in so-called press-formability has been developed. The 5000-series aluminum alloy sheet is high in strength due to the Mg forming a solid solution in the matrix and further is controlled in texture so is also excellent in press-formability, so has been used in the past as a material for automobile body panels.

For example, in Patent Literature 1, (PLT 1), an Al—Mg-series alloy sheet excellent in deep drawability has been developed. The sheet disclosed in PLT 1 contains 2 wt %-6 wt % Mg, and one or more of the elements Fe, Mn, Cr, Zr, and Cu totaling at least 0.03 wt % (when Cu is selected, the Cu comprises at least 0.2 wt %). Compositional upper limits disclosed are 0.2 wt % Fe, 0.6 wt % Mn, 0.3 wt % Cr, 0.3 wt % Zr, and 1.0% Cu, with a balance of Al and unavoidable impurities. The sheet in PLT 1 additionally has a texture with a ratio of CUBE orientation volume fraction to S orientation volume fraction (S/Cube) of 1 or more, at most 5 vol % GOSS orientation, and has a grain size of 20 to 100 micro-meters.

Furthermore, automobile body panel is coated and baked after press-forming, so sheet excellent in so-called "bake hardness" has been sought. For this reason, 6000-series aluminum alloy sheet controlled in texture and excellent in so-called press-formability has also been developed.

For example, Patent Literature 2 (PLT 2) further described regarding the texture of an aluminum alloy or an aluminum alloy sheet (below, "aluminum alloy sheet"), an aluminum alloy sheet for press-forming use characterized in that the orientation density of the CR orientation ({001}<520>, same below) is higher than the orientation density of all other orientations besides the CR orientation. The sheet disclosed in PLT 2 contains Si: 0.2% to 2.0% (mass %, same below) and Mg: 0.2% to 1.5%, further contains one or more of Cu: 1.0% or less, Zn: 0.5% or less, Fe: 0.5% or less, Mn: 0.3% or less, Cr: 0.3% or less, V: 0.2% or less, Zr: 0.15% or less, Ti: 0.1% or less, and B: 0.005% or less, and has a balance of unavoidable impurities and aluminum. According to this, by setting the rolling direction of cold rolling with respect to the rolling direction of hot rolling to become 90 degree, it is possible to raise the breaking limit at equal biaxial deformation, plane strain deformation, and mono-axial deformation and provide aluminum alloy sheet suitable for press-forming.

Furthermore, Patent Literature 3 (PLT 3) describes a high formability Al—Mg—Si-series alloy sheet treated with solution treatment. The sheet disclosed in PLT 3 contains Mg: 0.3 to 2.0% (mass %, same below) and Si: 0.3 to 2.5%, has a balance of Al and unavoidable impurities. The sheet has a structure in which the area ratio of the grains having {432} planes inclined within 9.0 degree in range from parallel with the sheet surface to the total area of the grains of all crystal orientations is 0.15 or more, alpha/beta is 2.0 or more when the highest among the orientation distribution functions of the orientations comprised of {111}<112>, {332}<113>, {221}<114>, and {221}<122> is a alpha and the higher among the orientation distribution functions of the orientations comprised of {001}<100> and {001}<110> is beta, and the average Lankford value is 0.9 or more.

In this regard, an automobile body panel requires hemming so as to crimp an outer panel and inner panel together. However, the 6000-series aluminum alloy sheet is inferior to 5000-series aluminum alloy sheet in so-called bendability etc., so fine cracks and surface roughness after bending have to be prevented. Furthermore, while thinner gauge and higher strength are demanded, springback at the time of press-forming has to be suppressed. In particular, with bending, there are many cases where defects such as fine cracks which seems to be caused by formation of high density shear bands occur. Suitable control of the recrystallized texture has become an issue.

For example, in PLT 1, an Al—Mg—Si alloy sheet material was used as a test material to prepare a single crystal. The effect which each crystal orientation has on bendability was studied in detail from the viewpoint of the formation of shear bands. According to this study, it became clear that there is a close relationship between the crystal orientation and bendability. In the study, the bendability of the test piece having the <001>//ND orientation was the best. Further, the bending anisotropy was also the smallest.

Furthermore, Patent Literature 4 (PLT 4) describes an aluminum alloy sheet excellent in formability. The sheet disclosed in PLT 4 contains Fe: 1.0 to 2.0 mass % and, further, Mn: 2.0 mass % or less, having a balance of aluminum and unavoidable impurities, and restricted in Ti as an unavoidable impurity to 0.01 mass % or less. The sheet has a structure with an average grain size of 20 micro-meters or less and an area rate of {110} oriented crystal of 25% or more. According to this, by electromagnetically stirring while DC casting, it is possible to achieve all of an elongation of 35% or more, an average r-value of 0.85 or more, a ball head bulging height of 33 mm or more, and a limited drawing ratio of 2.17 or more.

CITATION LIST

Patent Literature

PLT 1. Japanese Patent No. 4339869
PLT 2. Japanese Patent Publication No. 2009-019267A
PLT 3. Japanese Patent Publication No. 2012-224929A
PLT 4. Japanese Patent Publication No. 2010-121164A

Nonpatent Literature

NPLT 1. *Light Metals*, vol. 60, no. 5 (2010), p. 231-236

SUMMARY OF INVENTION

Technical Problem

It is true that the 5000-series and 6000-series aluminum alloy sheets are excellent in formability and provided with the properties as automobile body panels. However, in aluminum alloy sheet which contains Mg as an essential element, sometimes the oxide film which is formed on the surface is relatively thick and pickling or other surface treatment is required before press-forming. Furthermore, sometimes, at the time of press-forming, stretcher strain marks, ridging, and other surface patterns are formed. Further, the 6000-series aluminum alloy sheet may change in mechanical properties along with time due to natural aging after sheet production.

Further, PLT 4 describes 3000-series and 8000-series aluminum alloy sheets which do not contain Mg as an essential element, but the obtained cast ingot has to be shaved at both surfaces, then heat treated for homogenization, rolled, then annealed by final annealing. There are many production steps and the cost has been high.

From the above, it is necessary to produce 3000-series aluminum alloy sheet restricted in Mg content by a method of production with less steps. Further, when used as an automobile body panel, provision of excellent formability, in particular bendability, is naturally demanded. Further thinner gauge is also being demanded. It is also necessary to suppress springback after press-forming. Therefore, development of high strength 3000-series aluminum alloy sheet which is excellent in formability, in particular bendability and shape freezability, has been desired.

The present invention was created to solve this problem and has as its object to provide 3000-series aluminum alloy sheet which has a high strength enabling application to an automobile body panel by controlling a recrystallized texture obtained by annealing a rolled texture, which is excellent in formability, in particular bendability and shape freezability.

Solution to Problem

The high strength aluminum alloy sheet excellent in formability of the present invention achieves the above object by having a chemical composition containing Mn: 1.0 to 1.6 mass %, Fe: 0.1 to 0.8 mass %, Si: 0.5 to 1.0 mass %, and Ti: 0.005 to 0.10 mass %, restricted in Mg as an impurity of less than 0.10 mass %, and having a balance of Al and unavoidable impurities, having a metal structure which exhibits a recrystallized texture which has an area rate of second phase particles of a circle equivalent diameter of 1 μm or more of 1.5 to 3.5%, an average grain size of 20 to 50 μm, and a ratio $AR_{\{100\}}/AR_{\{123\}<634>}$ of an area rate of {100} oriented crystal parallel to the sheet surface and an area rate of { 123}<634> oriented crystal parallel to the sheet surface of 4.8 or more, and having a tensile strength of 155 MPa or more, a 0.2% yield strength of 100 MPa or less, and an elongation of 26% or more. To raise the strength, it may further contain Cu: less than 0.8 mass %.

The high strength aluminum alloy sheet excellent in bendability and shape freezability of the present invention is produced by continuously casting an aluminum alloy melt of the above composition using a thin slab continuous casting machine to a thickness 2 to 15 mm slab, directly coiling the slab in a roll without hot rolling it, then cold rolling the sheet, cold rolling the sheet by a final cold rolling rate of 70 to 95%, then final annealing it. As the final annealing, the method preferably comprises holding the sheet at a holding temperature of 450 to 560° C. for 10 to 60 seconds for continuous annealing.

Advantageous Effects of Invention

The aluminum alloy sheet of the present invention has a high strength, is high in elongation value, and further is relatively low in yield strength, so is suppressed in springback at the time of press-forming and as a result is excellent in shape freezability. Further, the recrystallized texture has a ratio of the area rate of {100} oriented crystal parallel to the sheet surface and the area rate of {123}<634> oriented crystal parallel to the sheet surface, that is, $AR_{\{100\}}/AR_{\{123\}<634>}$, of 4.8 or more, so is particularly excellent in bendability. Further, by restricting the average grain size of the recrystallized texture to 20 to 50 μm in range, it is possible to prevent surface roughening after press-forming and after bending and to obtain a shaped part exhibiting an excellent surface appearance. Therefore, according to the present invention, high strength aluminum alloy sheet excellent in formability and shape freezability which can be applied to an automobile body panel etc. is provided at a low cost.

DESCRIPTION OF EMBODIMENTS

Conventional 3000-series aluminum alloy sheet, while high in strength, often suffers from defects such as fine cracks or surface roughness in appearance in particular in bending. For this reason, it is necessary to suitably control the recrystallized texture and suitably adjust the recrystallized grain size and crystal orientation. Further, 3000-series aluminum alloy sheet, while depending on the chemical composition or production process, sometimes has a high yield strength. Springback easily occurs after press-forming and the predetermined design shape cannot be held, that is, there are problems in so-called "shape freezability". Further, 3000-series aluminum alloy sheet sometimes suffers from surface roughness in surface appearance after press-forming and after bending. Therefore, as the material used, one which has high strength, high elongation, low yield strength, and suitably controlled recrystallized texture has been sought.

As explained above, to control the rolled texture of aluminum alloy sheet, for example, there is also the method of adjusting the rolling process such as using differential speed rolling where the circumferential speeds of the top and bottom rolls differ. Whatever the case, to improve the bendability in 3000-series aluminum alloy sheet which is used for an automobile body panel, it is necessary to control the recrystallized texture of the final sheet (annealed sheet).

Further, on the other hand, as the method of evaluation of the bendability, in the past, the general widespread practice had been to compare the appearance of a bent part of a test piece in the bending test with an evaluation sample and rank it in for example five stages. However, the evaluation in this case employs the technique of comparison with a sample, but for the appearance of the bent part, visual examination must be relied on. Therefore, to reduce the defect rate such as fine cracks and surface roughening in appearance in bending, it is important to evaluate the bendability in a bending test and to measure the crystal orientation, grain size, etc. in the recrystallized texture and quantitatively evaluate the metal structure. The inventors engaged in intensive studies, through investigations of the recrystallized texture, to obtain aluminum alloy sheet excellent in formability, in particular bendability and shape freezability and thereby completed the present invention. Below, the content will be explained.

First, the actions, suitable contents, etc. of the elements which are included in the 3000-series aluminum alloy sheet of the present invention will be explained.

Mn: 1.0 to 1.6 Mass %

Mn is an element which increases the strength of the aluminum alloy sheet. A part of Mn forms a solid solution in the matrix to promote solution strengthening, so this is an essential element. Further, Mn is also an element which forms Al—(Fe.Mn)—Si and other fine intermetallic compounds at the time of casting if in the range of the alloy composition of the present invention. Furthermore, at the time of final annealing, the Mn which had formed a solid solution in the matrix also partially precipitates as fine intermetallic compounds and raises the strength.

If the Mn content is over 1.6 mass %, the aluminum alloy sheet becomes too high in yield strength and falls in shape freezability at the time of press-forming, so is not preferable. Furthermore, the temperature required for causing recrystallization at the time of final annealing becomes too high and the productivity falls, so this is not preferable. Further, if the Mn content is less than 1.0 mass %, the aluminum alloy sheet becomes too low in strength, so this is not preferable.

Therefore, the preferable Mn content is made 1.0 to 1.6 mass % in range. The more preferable Mn content is 1.05 to 1.6 mass % in range. The still more preferable Mn content is 1.1 to 1.6 mass % in range.

Fe: 0.1 to 0.8 Mass %

Fe, while depending on the cooling rate at the time of ingot casting, causes the precipitation of A—(Fe.Mn)—Si or other fine intermetallic compounds and increases the strength of the aluminum alloy sheet. Further, at the time of final annealing, a part of the Mn which forms a solid solution in the matrix is diffused and absorbed in these intermetallic compounds, so the final annealed sheet is lowered in yield strength and raised in elongation. These fine intermetallic compounds act as nuclei of recrystallized grains at the time of final annealing. By adjusting the grain size of the recrystallized texture to a predetermined range, it is possible to prevent surface roughening after press-forming, so this is an essential element.

If the Fe content is less than 0.1 mass %, the Al—(Fe.Mn)—Si and other intermetallic compounds are reduced in size and number so the second phase particles are reduced in area rate and the effect of refining the recrystallized grains becomes weaker. Further, due to the action of preventing recrystallization of the Mn forming a solid solution in the matrix, a predetermined recrystallized texture is not obtained, so this is not preferable. If the Fe content exceeds 0.8 mass %, the Al—(Fe.Mn)—Si and other intermetallic compounds are increased in size and number, so the second phase particles are increased in area rate. At the time of final annealing, the amount of Mn forming a solid solution in the matrix is reduced, the elongation becomes high, and the yield strength becomes low, but the strength falls, so this is not preferable.

Therefore, the Fe content is made 0.1 to 0.8 mass % in range. The more preferable Fe content is 0.1 to 0.7 mass % in range. The still more preferable Fe content is 0.15 to 0.6 mass % in range.

Si: 0.5 to 1.0 Mass %

Si, while depending on the cooling rate at the time of casting an ingot, causes the precipitation of Al—(Fe.Mn)—Si and other fine intermetallic compounds and increases the aluminum alloy sheet in strength. Further, a part of Si forms a solid solution in the matrix and raises the strength. At the time of final annealing, a part of the Mn which forms a solid solution in the matrix is diffused and absorbed in these intermetallic compounds, so causes the final annealed sheet to fall in yield strength and to rise in elongation. These fine intermetallic compounds act as nuclei for recrystallized grains at the time of final annealing and enable adjustment of the recrystallized grains in grain size to a predetermined range to thereby prevent surface roughening after press-forming, so this is an essential element.

If the Si content is less than 0.5 mass %, the Al—(Fe.Mn)—Si and other intermetallic compounds fall in size and number, so the second phase particles fall in area rate and, further, the matrix falls in amount of solid solution of Si, so the predetermined strength is not obtained, so this is not preferable. If the Si content exceeds 1.0 mass %, the aluminum alloy sheet becomes higher in strength, but falls in elongation and falls in formability, so this is not preferable.

Therefore, the Si content is made 0.5 to 1.0 mass % in range. The more preferable Si content is 0.55 to 1.0 mass % in range. The still more preferable Si content is 0.6 to 1.0 mass % in range.

Ti: 0.005 to 0.10 Mass %

Ti acts as a grain refining agent at the time of ingot casting and can prevent ingot cracking, so is an essential element. Of course, Ti may also be added alone, but by presence together with B, a more powerful effect of refining grains can be expected, so it may also be added by an Al-5% Ti-1% B or other rod hardener.

If the Ti content is less than 0.005 mass %, the refining effect at the time of ingot casting is insufficient, so casting cracking is liable to be incurred, so this is not preferable. If the Ti content is over 0.10 mass %, at the time of ingot casting, $TiAl_3$ and other coarse intermetallic compounds precipitate and the press-formability and bendability are liable to be lowered at the final sheet, so this is not preferable.

Therefore, the Ti content is made 0.005 to 0.10 mass % in range. The more preferable Ti content is 0.005 to 0.07 mass % in range. The still more preferable Ti content is 0.01 to 0.05 mass % in range.

Mg: Less than 0.10 Mass %

Mg becomes a cause of formation of relatively thick oxide film at the surface of the final sheet (annealed sheet). As a result, the need arises to sufficiently pickle the final sheet. This becomes a factor increasing the costs. Furthermore, in the alloy composition of the present invention, the Si content is relatively high, so if Mg is contained, $Mg_2Si$ precipitates, so the elongation becomes low and the formability is lowered. Therefore, the preferable Mg content is less than 0.10 mass % in range. The more preferable Mg content is less than 0.05 mass % in range. The still more preferable Mg content is less than 0.03 mass % in range.

Less than Cu: 0.8 Mass %

Cu is an element which increases the strength of aluminum alloy sheet and is an optional element. In the present invention, if the Cu content is less than 0.8 mass % in range, the bendability and shape freezability and other properties will not fall. However, if the Cu content is 0.8 mass % or more, the corrosion resistance remarkably falls. Therefore, the preferable Cu content is less than 0.8 mass % in range. The more preferable Cu content is less than 0.5 mass % in range. The still more preferable Cu content is less than 0.2 mass % in range.

Other Unavoidable Impurities

Unavoidable impurities unavoidably enter from the starting material metal, recycled materials, etc., so the allowable contents of these are, for example, Cr: less than 0.20 mass %, Zn: less than 0.20 mass %, Ni: less than 0.10 mass %, Ga and V: less than 0.05 mass %, Pb, Bi, Sn, Na, Ca, Sr: respectively less than 0.02 mass %, and others: less than 0.05 mass %. Even if containing unmanaged elements in this range, the effects of the present invention are not inhibited.

Tensile Strength: 155 MPa or More, 0.2% Yield Strength: 100 MPa or Less, Elongation: 26% or More In this regard, in applying 3000-series aluminum alloy sheet to an automobile body panel etc., it is necessary to not only have high strength and excellent formability, but also to be excellent in shape freezability at the time of press-forming. The strength of the material can be learned by the tensile strength at the time of a tensile test, the formability by the elongation at the time of a tensile test, and the shape freezability by the yield strength at the time of a tensile test.

Details will be left to the description in the later explained examples. As the 3000-series aluminum alloy sheet of the present invention which is applied to an automobile body panel etc., one which has, as the final annealed sheet, the properties of a tensile strength of 155 MPa or more, a 0.2% yield strength of 100 MPa or less, and an elongation of 26% or more is suitable.

Area Rate of Second Phase Particles of Circle Equivalent Diameter of 1 μm or More: 1.5 to 3.5%

Average Grain Size: 20 to 50 μm $AR_{\{100\}}/AR_{\{123\}<634>}$ Ratio: 4.8 or More The above properties were obtained by finely adjusting the metal structure of the 3000-series aluminum alloy sheet having the above specific chemical composition. Specifically, the metal structure may be made a recrystallized texture with an area rate of second phase particles of a circle equivalent diameter of 1 μm or more of 1.5 to 3.5%, an average grain size of 20 to 50 μm, and a ratio of an area rate of {100} oriented crystal parallel to the sheet surface and the area rate of { 123}<634> oriented crystal parallel to the sheet surface, that is, an $AR_{\{100\}}/AR_{\{123\}<634>}$ ratio, of 4.8 or more. In particular, by making the average grain size in the recrystallized texture 20 to 50 μm, it is possible to prevent surface roughness after press-forming or after bending and possible to obtain a press-formed article excellent in surface appearance. Further, to reduce the rate of defects such as fine cracks in bending, the ratio of an area rate of {100} oriented crystal parallel to the sheet surface and the area rate of {123}<634> oriented crystal parallel to the sheet surface in the recrystallized texture, that is, the $AR_{\{100\}}/AR_{\{123\}<634>}$ ratio, has to be made 4.8 or more.

Details will be left to the later explained examples, but as the 3000-series aluminum alloy sheet of the present invention which is applied to an automobile body panel etc., a final annealed sheet which has a recrystallized texture of an area rate of circle equivalent diameter 1 μm or more second phase particles of 1.5 to 3.5%, an average grain size of 20 to 50 μm, and an $AR_{\{100\}}/AR_{\{123\}<634>}$ of 4.8 or more is suitable.

Further, while the details will be left to the later explained examples, whatever the case, so long as having the above specific chemical composition and having the above such recrystallized texture, the final annealed sheet exhibits a tensile strength of 155 MPa or more, a 0.2% yield strength of 100 MPa or less, and an elongation of 26% or more.

Next, one example of the method of producing such a press-forming-use aluminum alloy sheet will be simply explained.

Melting and Refining

The starting material was charged into the melting furnace. After reaching a predetermined melting temperature, flux was suitably charged and the melt was stirred. Furthermore, according to need, a lance etc. was used to degas the inside of the furnace, then the melt was held to settle and the slag was separated from the surface of the melt.

In this melting and refining, to obtain the predetermined alloy ingredients, it is important to again charge the master alloy and alloy metals and other starting materials, but it is extremely important to take sufficient settling time until the flux and slag floats up from the aluminum alloy melt to the melt surface and is separated. The settling time is usually preferably 30 minutes or more.

The aluminum alloy melt which is refined in the melting furnace is sometimes transferred once to a holding furnace then cast, but sometimes is also directly tapped from the melting furnace and cast. The more preferable settling time is 45 minutes or more.

In accordance with need, inline degassing or filtering may also be performed. The inline degassing is usually performed by blowing an inert gas etc. from a rotary rotor to the aluminum melt, then causing the hydrogen gas in the melt to diffuse in the bubbles of the inert gas for removal. When using nitrogen gas as the inert gas, it is important to for example manage the dew point to −60° C. or less. The amount of hydrogen gas of the cast ingot is preferably reduced to 0.20 cc/100 g or less.

If the amount of hydrogen gas of the cast ingot is large, porosity is liable to occur in the final solidified parts of the cast ingot, so the reduction per pass in the cold rolling process is preferably restricted to for example 20% or more to crush the porosity. Further, the hydrogen gas which forms a solid solution in the cast ingot in a supersaturated state, while depending also on the annealing and other heat treatment conditions for a cold roll, sometimes precipitates even after press-forming the final sheet, for example, at the time of spot welding and causes the formation of a large number of blow holes at the spot beads. Therefore, the more preferable amount of hydrogen gas of the cast ingot is 0.15 cc/100 g or less.

Thin Slab Continuous Casting

"Thin slab continuous casting machines" include twin belt casting machines and twin roll casting machines. A twin belt casting machine is provided with a pair of rotating belt parts which are provided with endless belts and face each other at the top and bottom, a cavity which is formed between the pair of rotating belt parts, and cooling means which are provided inside of the rotating belt parts. It is supplied with a metal melt into its cavity through a nozzle made of a refractory and continuously casts a thin slab.

A twin roll casting machine is provided with a pair of rotating roll parts which are provided with endless rolls and face each other at the top and bottom, a cavity which is formed between the pair of rotating roll parts, and cooling means which are provided inside of the rotating roll parts. It is supplied with a metal melt into its cavity through a nozzle made of a refractory and continuously casts a thin slab.

Slab Thickness of 2 to 15 mm

The thin slab continuous casting machine can continuously cast a thickness 2 to 15 mm thin slab. If the slab thickness is less than 2 mm, even when casting is possible, while depending on the thickness of the final sheet, it becomes difficult to realize the later explained final rolling rate of 70 to 95%. If over a slab thickness of 15 mm, it becomes difficult to wind the slab directly in a roll. If in this slab thickness in range, the cooling rate of the slab becomes 40 to 1000° C./sec near ¼ of the slab thickness, so the Al—(Fe.Mn)—Si and other intermetallic compounds finely precipitate. For this reason, in the final annealed sheet, it becomes possible to obtain a metal structure with an area rate of circle equivalent diameter 1 μm or more intermetallic compounds (second phase particles) of 1.5 to 3.5%. These fine intermetallic compounds become nuclei for recrystallized grains at the time of later explained final annealing of the cold rolled sheet. The average grain size of the recrystallized grains in the final sheet can be adjusted to 20 to 50 μm.

Cold Rolling

A thin slab continuous casting machine was used to continuously cast a slab, the slab was directly taken up in a roll without hot rolling, then this was cold rolled. For this reason, the shaving process, homogenization process, and hot rolling process which were necessary in the conventional semicontinuous cast DC slab can be omitted. The coil of the directly taken up thin slab is passed through a cold rolling machine and cold rolled by normally several passes. At this time, the plastic strain which is introduced by the cold rolling causes work hardening, so in accordance with need, it is possible to hold the sheet in a batch furnace at a holding temperature of 300 to 400° C. for 1 to 8 hours as process annealing.

Final Cold Reduction of 70 to 95%

After cold rolling by a final cold reduction of 70 to 95%, final annealing is performed. If the final cold reduction is in this range, the average grain size in the final sheet after annealing can be made 20 to 50 μm and the value of elongation can be made 26% or more while the surface appearance after press-forming can be made beautiful in finish. Therefore, the processing cost can be kept low and the amount of solid solution of the transition metal elements can be secured while applying work so dislocations build up and recrystallized grains adjusted to 20 to 50 μm can be obtained by the final annealing process. If the final cold reduction is less than 70%, the amount of work strain which builds up at the time of cold rolling becomes too small and it is not possible to obtain 20 to 50 μm recrystallized grains by the final annealing. If the final cold reduction exceeds 95%, the amount of work strain which builds up at the time of cold rolling becomes too great and the work hardening becomes severe, edge cracking occurs, and rolling becomes difficult. Therefore, the preferable final cold reduction is 70 to 95% in range. The more preferable final cold reduction is 75 to 95% in range. The still more preferable final cold reduction is 75 to 90% in range.

Final Annealing

Using Continuous Annealing Furnace to Hold at Holding Temperature of 450 to 560° C. for 10 to 60 Seconds The final annealing is preferably continuous annealing where a continuous annealing furnace is used to hold the sheet at 450° C. to 560° C. in holding temperature for 10 to 60 seconds. If cooling by a fast speed after that, this can also serve as solution treatment. To raise the press-formability and bendability in the forming process, it is necessary to make the material one treated by solution treatment. Due to the final annealing, the Mn which forms a solid solution in the matrix is absorbed in the finely precipitated intermetallic compounds. Due to this, recrystallization is promoted and the final annealed sheet is lowered in yield strength and raised in elongation. At the same time, the density of {123}<634> oriented crystal parallel to the sheet surface in the metal structure is reduced and the density of {100} oriented crystal parallel to the sheet surface increases.

If the holding temperature is less than 450° C., it becomes difficult to obtain a recrystallized texture. If the holding temperature exceeds 560° C., the thermal strain becomes severer and, while depending on the alloy composition, burning is liable to occur. If the holding time is less than 10 seconds, the actual temperature of the coil does not reach a predetermined temperature and the annealing treatment is liable to become insufficient. If the holding time is over 60 seconds, the treatment takes too much time and the productivity falls.

In the method of production of the present invention, the final annealing is an essential process. By this final annealing, the final sheet is held at the recrystallization temperature or higher temperature to thereby realize a recrystallized texture with an average grain size of 20 to 50 μm and, furthermore, a ratio of the area rate of the {100} oriented crystal parallel to the sheet surface and the area rate of the {123}<634> oriented crystal parallel to the sheet surface, that is, the $AR_{\{100\}}/AR_{\{123\}<634>}$ ratio, of 4.8 or more. The final annealed sheet having such a recrystallized texture has a statistically smaller Taylor factor in the bending in all directions in the sheet surface, so slip deformation in the (111) plane in the grain becomes easy by a relatively small stress and the bendability becomes excellent. Further, since the average grain size is adjusted to 20 to 50 μm, the mean free path of movable dislocations in the grains also is believed to become sufficiently larger for the localized plastic deformation such as bending. By going through the above such normal continuous casting process, it is possible to obtain an aluminum alloy sheet excellent in bendability and shape freezability.

EXAMPLES

Fabrication of Thin Slab Continuous Casting Simulated Material

Various ingots of 5 kg each of the compositions of the 11 levels shown in Table 1 (Alloy Nos. 1 to 11) were inserted into #20 crucibles. These crucibles were heated in small-sized electric furnaces to melt the ingots. Next, lances were inserted into the melts and $N_2$ gas was blown in by flow rates of 1.0 liter/min for 5 minutes for degassing. After that, the melts were allowed to settle for 30 minutes and the slag floating up to the melt surfaces were removed by stirring rods. Next, the crucibles were taken out from the small sized electric furnace and the melts were poured into inside dimension 200×200×16 mm water cooled molds to prepare thin slabs. The disk samples of the test materials taken from the melts in the crucibles (Examples 1 to 5 and Comparative Examples 1 to 6) were analyzed for composition by emission spectrophotometry. The results are shown in Table 1. The thin slabs were shaved at their two surfaces by 3 mm each to thicknesses of 10 mm, then, without homogenization or hot rolling, were cold rolled to obtain thickness 1.0 mm cold rolled sheets. Note that, no process annealing treatment was performed between cold rolling processes. The final cold rolling rates in this case were 90%.

Next, the cold rolled materials were cut to predetermined sizes, then the cold rolled materials were inserted into a salt bath, held at 550° C.×15 sec, quickly taken out from the salt bath, then water cooled and treated by solution treatment. The thus obtained final sheets (test materials) were used as thin slab continuous casting simulated materials. Table 1 shows the chemical compositions.

TABLE 1

Chemical Compositions of Test Materials

| | Alloy no. | Chemical composition (wt %) | | | | | | | |
|---|---|---|---|---|---|---|---|---|---|
| | | Si | Fe | Cu | Mn | Mg | Zn | Ti | Al |
| Ex. 1 | 1 | 0.97 | 0.53 | 0.07 | 1.48 | <0.01 | <0.01 | 0.02 | Bal. |
| Ex. 2 | 2 | 0.98 | 0.19 | 0.07 | 1.51 | <0.01 | <0.01 | 0.02 | Bal. |
| Ex. 3 | 3 | 0.55 | 0.34 | 0.08 | 1.46 | <0.01 | <0.01 | 0.02 | Bal. |
| Ex. 4 | 4 | 0.96 | 0.47 | <0.01 | 1.49 | <0.01 | <0.01 | 0.02 | Bal. |
| Ex. 5 | 5 | 0.54 | 0.35 | 0.65 | 1.04 | <0.01 | <0.01 | 0.02 | Bal. |
| Comp. Ex. 1 | 6 | 0.54 | 0.35 | 0.24 | 1.14 | 0.35 | <0.01 | 0.02 | Bal. |
| Comp. Ex. 2 | 7 | 0.53 | 0.35 | 0.23 | 1.30 | 0.34 | <0.01 | 0.02 | Bal. |
| Comp. Ex. 3 | 8 | 0.54 | 0.61 | 0.23 | 1.48 | 0.25 | <0.01 | 0.02 | Bal. |
| Comp. Ex. 4 | 9 | 0.54 | 0.36 | 0.24 | 1.46 | 0.26 | <0.01 | 0.02 | Bal. |
| Comp. Ex. 5 | 10 | 0.49 | 1.00 | <0.01 | 1.49 | <0.01 | <0.01 | 0.02 | Bal. |
| Comp. Ex. 6 | 11 | 1.08 | 0.70 | 0.02 | 1.98 | <0.01 | 1.19 | 0.02 | Bal. |

*) The underlined values in the table show values outside the scope of composition of the present invention.

Next, the thus obtained final sheets (test materials) were evaluated for metal structures and measured and evaluated for various properties.

Measurement of Crystal Orientation and Grain Size

The obtained final annealed sheets (test materials) were measured for crystal orientation by EBSD. From the test materials, vertical cross-sections parallel to the rolling direction were cut out and polished to mirror finishes. Furthermore, the strain caused by the polishing was removed by electrolytic polishing. The test pieces were measured for crystal orientation by EBSD. The scanning electron microscope used was a JSM6490A made by JEOL set to conditions of an acceleration voltage of 15 kV, WD 3 mm, and slant of 65°. The EBSD measurement was performed by a model OIM made by TSL Solutions over a region from 0.16 to 0.32 square mm in 2 μm steps. The obtained results were analyzed by analysis software (OIM analysis) to find the area rate of {100} oriented crystal parallel to the sheet surface and the area rate of {123}<634> oriented crystal parallel to the sheet surface. Here, the {100} orientation was made an orientation of 10° in range from { 100}. The {123}<634> orientation (S orientation) was made an orientation of 15° in range from {123}<634>. Similarly, analysis software was used to calculate the average grain size (circle equivalent diameter). The results of measurement are shown in Table 2.

Measurement of Area Rate of Second Phase Particles in Metal Structure

The cross-sectional surface parallel to the rolling direction of the obtained final sheet (cross-section vertical to LT direction) was cut out, buried in a thermoplastic resin, polished to a mirror finish, then etched by a hydrofluoric acid aqueous solution to observe the metal structure. The micro metal structure was photographed by an optical microscope (area per field: 0.017 $mm^2$, 20 fields taken for each sample) and the photograph was analyzed by image analysis to find the area rate of second phase particles of a circle equivalent diameter of 1 μm or more. The results of measurement are shown in Table 2.

TABLE 2

Results of Evaluation of Test Materials

| | Alloy no. | Second phase particle area rate (%) | Average grain size (μm) | Area rate of oriented crystal (%) | | $AR_{\{100\}}/AR_{\{123\}<634>}$ |
|---|---|---|---|---|---|---|
| | | | | $AR_{\{100\}}$ | $AR_{\{123\}<634>}$ | |
| Ex. 1 | 1 | 3.2 | 31 | 5.9 | 1.0 | 5.9 |
| Ex. 2 | 2 | 1.8 | 28 | 8.5 | 1.7 | 5.0 |
| Ex. 3 | 3 | 1.9 | 20 | 9.3 | 0.8 | 11.6 |
| Ex. 4 | 4 | 2.9 | 43 | 8.0 | 0.9 | 8.9 |
| Ex. 5 | 5 | 1.7 | 21 | 9.7 | 1.2 | 8.1 |
| Comp. Ex. 1 | 6 | 1.7 | 14 | 6.9 | 1.5 | 4.6 |
| Comp. Ex. 2 | 7 | 1.8 | 14 | 8.2 | 1.8 | 4.6 |
| Comp. Ex. 3 | 8 | 3.2 | 16 | 9.6 | 1.2 | 8.0 |
| Comp. Ex. 4 | 9 | 2.3 | 18 | 7.8 | 2.8 | 2.8 |
| Comp. Ex. 5 | 10 | 4.4 | 17 | 6.5 | 2.4 | 2.7 |
| Comp. Ex. 6 | 11 | 4.7 | — | — | — | — |

*) Comparative Example 6 had a non-recrystallized texture, so the grain size and the crystal orientation for Comparative Example 6 were not measured.

Measurement of Various Properties by Tensile Tests

The obtained final sheets (test materials) were evaluated for properties by the tensile strength, 0.2% yield strength, and elongation (%) of tensile tests. Specifically, from the obtained test materials, JIS No. 5 test pieces were taken to give a tensile direction parallel to the rolling direction and were tested by tensile tests based on JISZ2241 to find the tensile strength, 0.2% yield strength, and elongation (elongation at break). Note that, these tensile tests were conducted on the test materials three times (n=3) each and the average values were calculated. A test material with a tensile strength in the final sheet of 155 MPa or more was deemed good in strength, while a test material with a value of less than 155 MPa was deemed insufficient in strength. Further, a test material with a 0.2% yield strength of 100 MPa or less was deemed good in shape freezability, while a test material with a value of over 100 MPa was deemed poor in shape freezability. Furthermore, a test material with a value of elongation of 26% or more was deemed good in formability, while a test material with a value of less than 26% was deemed poor in formability. The results of evaluation are shown in Table 3.

Evaluation of Bendability by Bending Test

As the test pieces for the bending test, test pieces having the 90° direction to a longitudinal direction and having 25 mm×50 mm dimensions were taken from each test material. The bending test was conducted by pushing a punch with a punch diameter of 1 mm against each test piece in a 90° direction with respect to the longitudinal direction of the test piece, bending 40° to 60° in that state, then pressing test pieces together until closely fitting. The bendability was evaluated by the surface conditions of the bent part after bending. Conditions of no cracks or wrinkles to breakage were ranked as 0 to 5 points. A test material with 0 to 1 point was evaluated as good in bendability, while a test material with 2 to 5 points was evaluated as poor in bendability.

TABLE 3

Results of Evaluation of Test Materials

| | | Tensile properties | | | Bending | Evaluation | | | | |
|---|---|---|---|---|---|---|---|---|---|---|
| | Alloy no. | UTS (MPa) | YS (MPa) | El (%) | test Points | Strength | Shape freeze-ability | Form-ability | Bend-ability | Overall |
| Ex. 1 | 1 | 185 | 100 | 27 | 1 | G | G | G | G | G |
| Ex. 2 | 2 | 180 | 96 | 26 | 1 | G | G | G | G | G |
| Ex. 3 | 3 | 158 | 87 | 27 | 1 | G | G | G | G | G |
| Ex. 4 | 4 | 174 | 88 | 28 | 1 | G | G | G | G | G |
| Ex. 5 | 5 | 180 | 83 | 28 | 1 | G | G | G | G | G |
| Comp. Ex. 1 | 6 | 199 | 99 | 25 | — | G | G | P | — | P |
| Comp. Ex. 2 | 7 | 198 | 99 | 25 | 2 | G | G | P | P | P |
| Comp. Ex. 3 | 8 | 194 | 98 | 24 | 2 | G | G | P | P | P |
| Comp. Ex. 4 | 9 | 194 | 102 | 23 | 2 | G | P | P | P | P |
| Comp. Ex. 5 | 10 | 150 | 77 | 34 | — | P | G | G | — | P |
| Comp. Ex. 6 | 11 | 231 | 179 | 16 | — | G | P | P | — | P |

*) G in the evaluation columns of the properties indicate "good", while P indicates "poor".

*) For Comparative Examples 1, 5, and 6, the bending test was not performed.

Results of Evaluation of Metal Structures of Test Materials

Examples 1 to 5 in Table 2 showing the results of evaluation of the metal structures of test materials are in the range of composition of the present invention. The $AR_{\{100\}}/AR_{\{123\}<634>}$ ratio, average grain size, and area rate of second phase particles all satisfied the reference values. That is, specifically, they satisfied the requirements of the $AR_{\{100\}}/AR_{\{123\}<634>}$ ratio: 4.8 or more, average grain size: 20 to 50 μm, area rate of second phase particles of circle equivalent diameter of 1 μm or more: 1.5 to 3.5%.

Comparative Example 1 is outside the scope of composition of the present invention. It had an average grain size of 14 μm, so did not satisfy the reference value, while had an $AR_{\{100\}}/AR_{\{}123\}<634>$ ratio of 4.6, so did not satisfy the reference value.

Comparative Example 2 is outside the scope of composition of the present invention. It had an average grain size of 14 μm, so did not satisfy the reference value, while had an $AR_{\{100\}}/AR_{\{123\}<634>}$ ratio of 4.6, so did not satisfy the reference value.

Comparative Example 3 is outside the scope of composition of the present invention. It had an average grain size of 16 μm, so did not satisfy the reference value.

Comparative Example 4 is outside the scope of composition of the present invention. It had an average grain size of 18 μm, so did not satisfy the reference value, while had an $AR_{\{100\}}/AR_{\{123\}<634>}$ ratio of 2.8, so did not satisfy the reference value.

Comparative Example 5 is outside the scope of composition of the present invention. It had an area rate of the second phase particles of 4.4%, so did not satisfy the reference value, had an average grain size of 17 μm, so did not satisfy the reference value, while had an $AR_{\{100\}}/AR_{\{123\}<634>}$ ratio of 2.7, so did not satisfy the reference value.

Comparative Example 6 is outside the scope of composition of the present invention. It had an area rate of the second phase particles of 4.7%, so did not satisfy the reference value. It had a nonrecrystallized texture, so was not measured for grain size and crystal orientation.

Evaluation of Properties of Test Materials

Examples 1 to 5 in Table 3 showing the results of evaluation of the properties of the test materials are in the scope of composition of the present invention. The tensile strengths, 0.2% yield strengths, elongations, and bendabilities all satisfied the reference values. Specifically, they satisfied the reference values of a tensile strength: 155 MPa or more, 0.2% yield strength: 100 MPa or less, elongation: 26% or more, bendability: 0 to 1 point. Note that the bending test was not performed for Comparative Examples 1, 5, and 6, so the bendability was unknown.

Comparative Example 1 had an Mg content of a high 0.35 mass %, so the alloy composition was outside the present invention in range and was evaluated as poor in formability.

Comparative Example 2 had an Mg content of a high 0.34 mass %, so the alloy composition was outside the present invention in range and was evaluated as poor in formability and evaluated as poor in bendability.

Comparative Example 3 had an Mg content of a high 0.25 mass % and an Fe content of a high 0.61 mass %, so the alloy composition was outside the present invention in range and was evaluated as poor in formability and evaluated as poor in bendability.

Comparative Example 4 had an Mg content of a high 0.26 mass %, so the alloy composition was outside the present invention in range and was evaluated as poor in shape freezability, evaluated as poor in formability, and evaluated as poor in bendability.

Comparative Example 5 had an Si content of a low 0.49 mass % and an Fe content of a high 1.00 mass %, so the alloy composition was outside the present invention in range and the strength was insufficient.

Comparative Example 6 had a Si content of a high 1.08 mass %, an Mn content of a high 1.98 mass %, and a Zn content of a high 1.19 mass %, so the alloy composition was outside the present invention in range and was evaluated as poor in shape freezability and evaluated as poor in formability.

From the above, it was learned that if having the above specific chemical composition and having the above such metal structure, the final annealed sheet exhibits a tensile strength of 155 MPa or more, a 0.2% yield strength of 100 MPa or less, and an elongation of 26% or more and is excellent in bendability.

The invention claimed is:

1. An aluminum alloy sheet having a chemical composition containing Mn: 1.0 to 1.6 mass %, Fe: 0.1 to 0.8 mass %, Si: 0.5 to 1.0 mass %, and Ti: 0.005 to 0.10 mass %, restricted in Mg as an impurity of less than 0.10 mass %, and having a balance of Al and unavoidable impurities, having a metal structure which exhibits a recrystallized texture which has an area rate of second phase particles of a circle equivalent diameter of 1 μm or more of 1.5 to 3.5%, an average grain size of 20 to 50 μm, and a ratio $AR_{\{100\}}/AR_{\{123\}<634>}$ of an area rate of {100} oriented crystal parallel to the sheet surface and an area rate of {123}<634> oriented crystal parallel to the sheet surface of 4.8 or more, and having a tensile strength of 155 MPa or more, a 0.2% yield strength of 100 MPa or less, and an elongation of 26% or more.

2. The aluminum alloy sheet according to claim 1 further containing Cu: less than 0.8 mass %.

3. A method of production of the aluminum alloy sheet according to claim 1 comprising continuously casting an aluminum alloy melt of a composition containing Mn: 1.0 to 1.6 mass %, Fe: 0.1 to 0.8 mass %, Si: 0.5 to 1.0 mass %, and Ti: 0.005 to 0.10 mass %, restricted in Mg as an impurity of less than 0.10 mass %, and having a balance of Al and unavoidable impurities, using a thin slab continuous casting machine to a thickness 2 to 15 mm slab, directly coiling said slab in a roll without hot rolling it, then cold rolling the sheet, cold rolling the sheet by a final cold rolling rate of 70 to 95%, then final annealing it.

4. The method of production of the aluminum alloy sheet according to claim 3 further comprising using a continuous annealing furnace to hold the sheet at a holding temperature of 450 to 560° C. for 10 to 60 seconds for final annealing.

5. A method of production of the aluminum alloy sheet according to claim 2 comprising continuously casting an aluminum alloy melt of a composition containing Cu: less than 0.8 mass %, Mn: 1.0 to 1.6 mass %, Fe: 0.1 to 0.8 mass %, Si: 0.5 to 1.0 mass %, and Ti: 0.005 to 0.10 mass %, restricted in Mg as an impurity of less than 0.10 mass %, and having a balance of Al and unavoidable impurities, using a thin slab continuous casting machine to a thickness 2 to 15 mm slab, directly coiling said slab in a roll without hot rolling it, then cold rolling the sheet, cold rolling the sheet by a final cold rolling rate of 70 to 95%, then final annealing it.

6. The method of production of the aluminum alloy sheet according to claim 5 further comprising using a continuous annealing furnace to hold the sheet at a holding temperature of 450 to 560° C. for 10 to 60 seconds for final annealing.

* * * * *